US006565245B2

(12) United States Patent
Yokoi

(10) Patent No.: US 6,565,245 B2
(45) Date of Patent: May 20, 2003

(54) HEADLAMP FOR VEHICLE

(75) Inventor: Syouichirou Yokoi, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/998,967

(22) Filed: Oct. 31, 2001

(65) Prior Publication Data

US 2002/0051365 A1 May 2, 2002

(30) Foreign Application Priority Data

Nov. 1, 2000 (JP) ..... 2000-334178

(51) Int. Cl.[7] ..... F21V 17/02

(52) U.S. Cl. ..... 362/512; 362/538; 362/539; 362/282; 362/322; 362/351

(58) Field of Search ..... 362/512, 513, 362/538, 539, 282, 284, 324, 322, 351, 361, 369, 390

(56) References Cited

U.S. PATENT DOCUMENTS 5,213,406 A 5/1993 Neumann et al. ..... 362/61
6,179,455 B1 * 1/2001 Taniuchi ..... 362/280
6,286,985 B1 9/2001 Ohshio et al. ..... 362/512

FOREIGN PATENT DOCUMENTS

GB 2345747 A 11/2000 ..... B60Q/1/14
JP 2000-207918 7/2000 ..... B60Q/1/14

* cited by examiner

*Primary Examiner*—Sandra O'Shea
*Assistant Examiner*—Bertrand Zeade
(74) *Attorney, Agent, or Firm*—Fish & Richardson PC

(57) ABSTRACT

A movable shade includes a shade main body in a cylindrical shape extending in a front and rear direction and a shade leg portion extending to a lower side from a lower end portion of the shade main body. Further, a strip extending in a peripheral direction of the shade main body is disposed at an upper end portion of a peripheral face of the shade main body to which the largest inertia load is carried. Thereby, rigidity of the shade main body is increased to achieve a thin-walled construction of the shade main body. Further, the movable shade is effectively restrained from being shifted to deteriorate its light blocking function by vibration while the vehicle is running.

10 Claims, 8 Drawing Sheets

LOW BEAM

HIGH BEAM

HEADLAMP FOR VEHICLE

BACKGROUND OF THE INVENTION

1. Field of the Invention

The present invention relates to a headlamp for a vehicle for changing a luminous intensity distribution by moving a movable shade.

2. Description of the Related Art

According to a headlamp for a vehicle, light from a light source is reflected towards the front by a reflector to illuminate a low beam or a high beam. Because a pattern for luminous intensity distribution differs between the low beam and the high beam, it is conventional to use a light source bulb having two light sources or two light source bulbs by which the beam is switched between low intensity and high intensity.

However, there is also known a headlamp for a vehicle constituted to switch a beam by a single light source. Particularly, in a two lights type headlamp using a discharge bulb as a light source bulb, there is frequently a case in which such a constitution is obliged to construct.

For a single light source, there is known a method of switching beams by moving a movable shade as disclosed in, for example, Japanese Patent Laid-Open No. 2000-207918. According to the method, a movable shade is moved between two predetermined positions at which a differing amount of light incident on a reflector from a light source is blocked.

According to such a headlamp for a vehicle, it is preferable to make the movable shade as light as possible to reduce a switching time and to decrease the knocking sound emitted by the movable shade coming into contact with a stopper.

However, it is also important to avoid a situation where the light-weight movable shade is shifted by vibration or the like while the vehicle is running. Such a problem generally occurs when the movable shade is moved to change a luminous intensity distribution.

SUMMARY OF THE INVENTION

An object of the present invention is to provide a headlamp for a vehicle in which a light-weight movable shade can change the luminous intensity distribution without deteriorating its light blocking function.

The invention achieves the above-described object by having a predetermined strip at a movable shade.

That is, according to the invention, there is provided a headlamp for a vehicle including a light source, a reflector for reflecting light from the light source in a front direction, a movable shade for blocking a portion of the light incident on the reflector from the light source, and a shade driving apparatus for moving the movable shade between two predetermined positions. The movable shade includes a shade main body of a cylindrical shape extending substantially in a front and rear directions, and a shade leg portion extending from the shade main body to an outer side of the shade main body substantially in a direction of a diameter thereof. At least one strip extending in a peripheral direction of the shade main body is disposed at a position substantially opposite to a position of the shade leg portion in a peripheral face portion of the shade main body.

The "light source" is not limited to but can be, for example, a discharge light emitting portion of a discharge bulb or can be a filament of an incandescent bulb such a halogen bulb.

The "movable shade" is not limited to a particular form as long as the shade can block the portion of light incident on the reflector from the light source bulb and the movable shade is integrally formed with the shade main body and the shade leg portion or is formed therewith separately.

The "two predetermined positions" may be positions for forming a luminous intensity distribution pattern for low beam and for high beam by disposing the movable shade at predetermined positions. The invention may include other positions for forming other luminous intensity distribution patterns.

The "shade driving apparatus" is not limited to a specific apparatus as the movable shade is configured to move between the two predetermined positions. For example, the movable shade can include a solenoid or a pulse motor. Further, the movement of the movable shade in the shade driving apparatus is not particularly limited to but can include pivotal movement or linear reciprocal movement.

The "strip" is not particularly limited any shape as long as the strip is formed to extend at least in the peripheral direction of the shade main body. For example, a strip can be a linear shape, or a curved shape or a strip can include a main strip and a sub strip branching from the main strip.

The headlamp for a vehicle according to the invention is provided with the movable shade including the shade main body in the cylindrical shape extended substantially in the front and rear direction and the shade leg portion extended from the shade main body to the outer side substantially in the direction of the diameter. The peripheral portion of the shade main body is formed with at least one strip extending in the peripheral direction and therefore, the rigidity of the shade main body can be increased and the thin-walled formation of the shade main body can be achieved. Further, the strip is formed at a position substantially opposite to a position of the extended shade leg portion in the peripheral face portion of the shade main body, that is, at a position operated with the largest inertia load in the shade main body. Accordingly the movable shade can be restrained from shifting or vibrating while the vehicle is running. Thus, the shade's blocking function can be effectively maintained.

Therefore, according to the invention, a light-weight movable shade can be implemented without deteriorating its light blocking function.

When the movable shade is pivotally moved in the front and rear directions with the predetermined portion of the shade leg portion as the pivotal center, a very large inertia load is carried at the position substantially opposite to the extended position of the shade leg portion in the peripheral face portion of the shade main body. Thus, the configuration of the present invention would be particularly effective in such a case.

The "shade leg portion" can be formed to extend in any direction relative to the shade main body as long as the shade leg portion extends from the shade main body to the outer side substantially in the direction of the diameter. However, when the shade leg portion is configured to extend to the lower side from the lower end portion of the shade main body, the strip is formed at the upper end portion of the shade main body. Thus, the rigidity of the shade main body can be increased with excellent left and right balance, thereby, shifting of the movable shade can be further restrained effectively.

When the shade main body of the movable shade is formed as a member in a cylindrical shape extending substantially in the front and rear directions as in the above-described configuration, it is preferable to provide the fixed shade on the front side for blocking direct light directed from the light source in the front direction by the fixed shade, depending on the kind of the light source. However, in order to prevent the fixed shade from interfering with the movable shade, it is necessary to provide the fixed shade at a position away from a pivotal locus of the movable shade. Consequently, the fixed shade is made large or the layout is restricted.

Hence, when a notch in a predetermined shape is formed at the front portion of the extended position of the shade leg portion in the movable shade, the movable shade interferes less with the fixed shade in pivotal movement and therefore, a small fixed shade can be implemented or the fixed shade can be provided at a position proximate to the movable shade. Further, by forming a notch, the movable shade can further be made light. In this case, the shape of the "notch" can be set in accordance with the structure of the light piece to the extent that it does not deteriorate the light blocking function of the movable shade.

BRIEF DESCRIPTION OF THE DRAWINGS

FIG. 6(*a*) shows a luminous intensity distribution pattern for low beam and FIG. 6(*b*) shows a luminous intensity distribution pattern for high beam.

DETAILED DESCRIPTION OF THE PREFERRED EMBODIMENTS

An explanation will be given of embodiments of the invention in reference to the drawings as follows.

Figure 1:
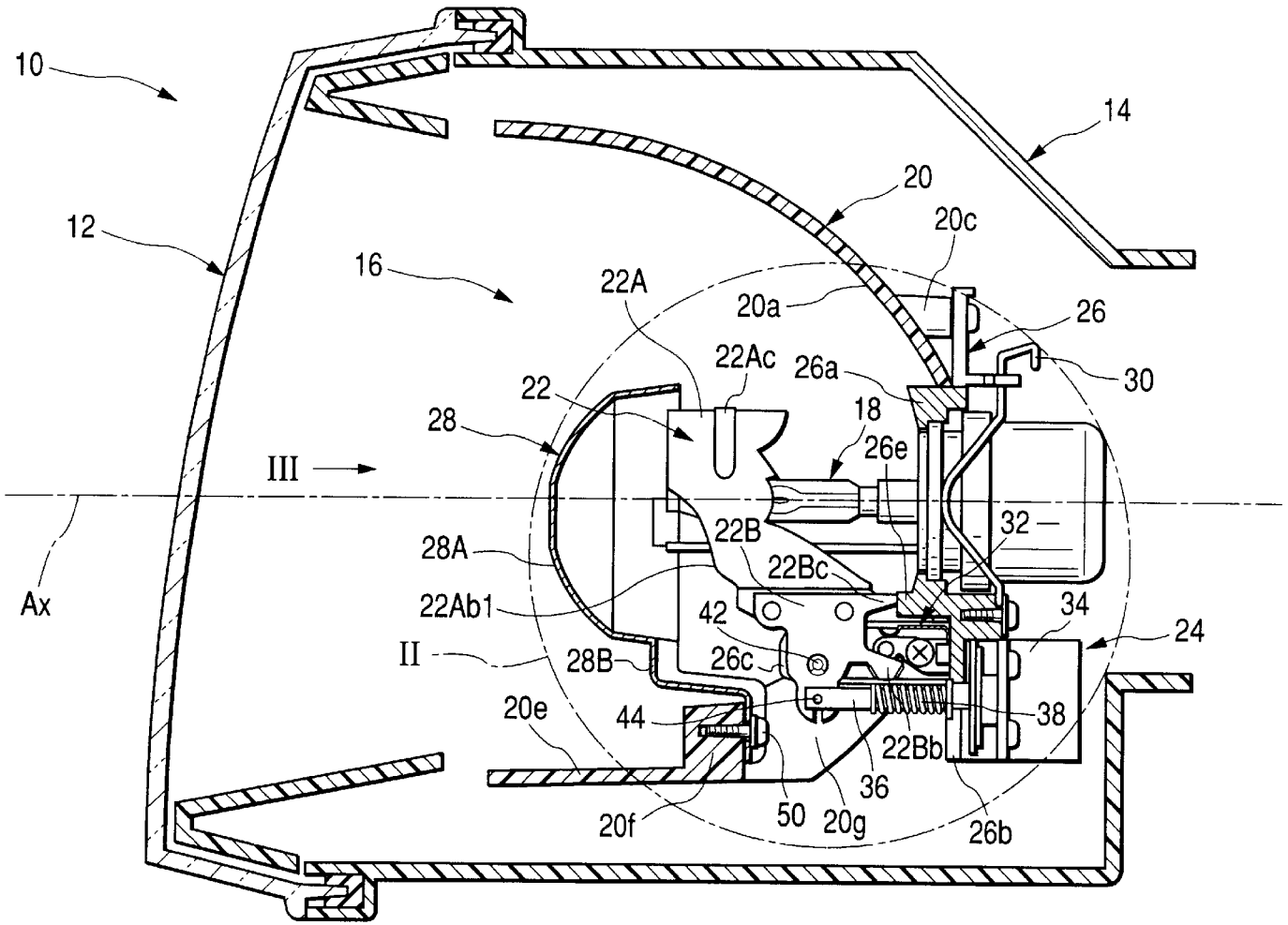
FIG. 1 is a side sectional view showing a headlamp for a vehicle according to an embodiment of the invention.
Figure 2:
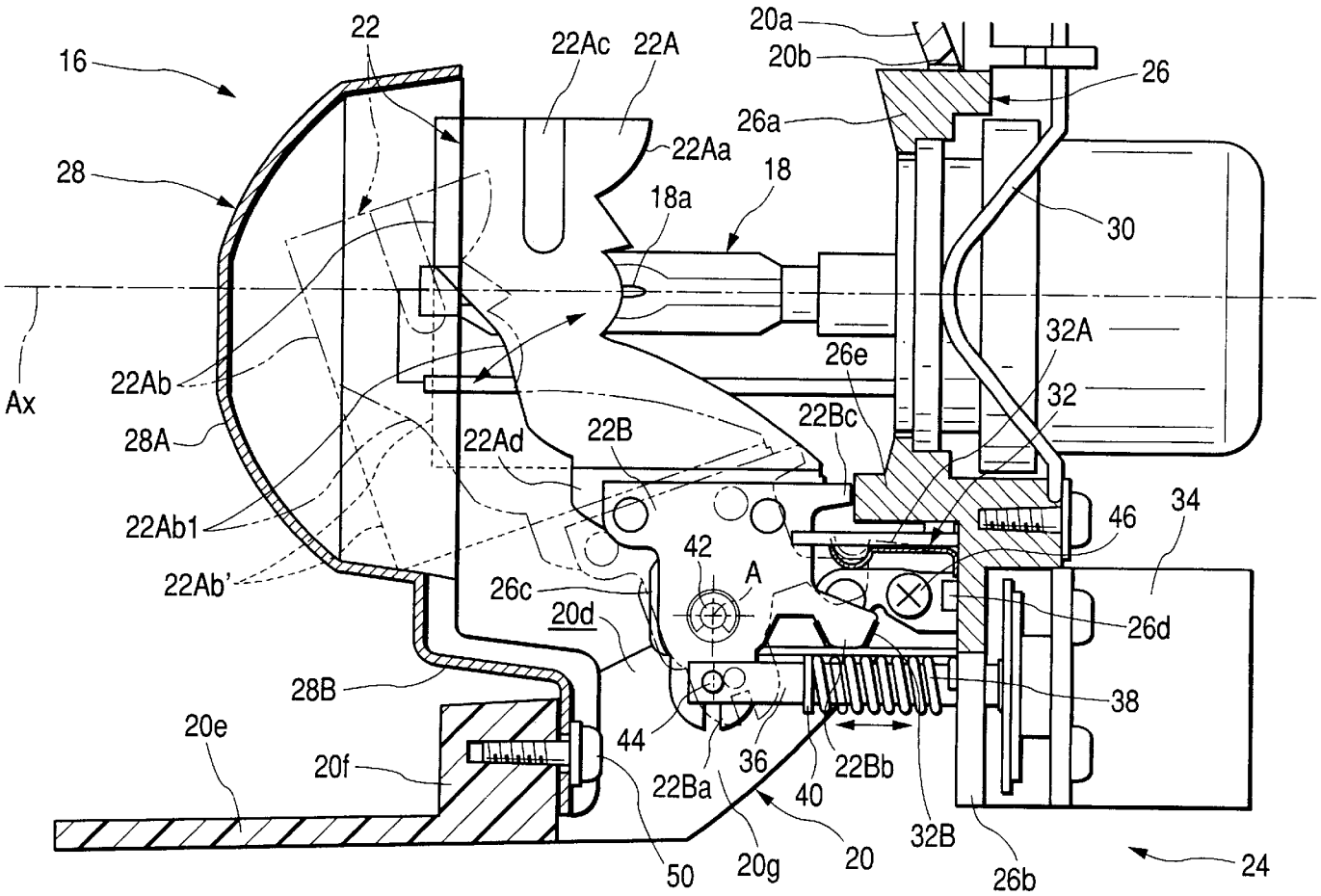
FIG. 2 is a detailed view of portion II of FIG. 1.
Figure 3:
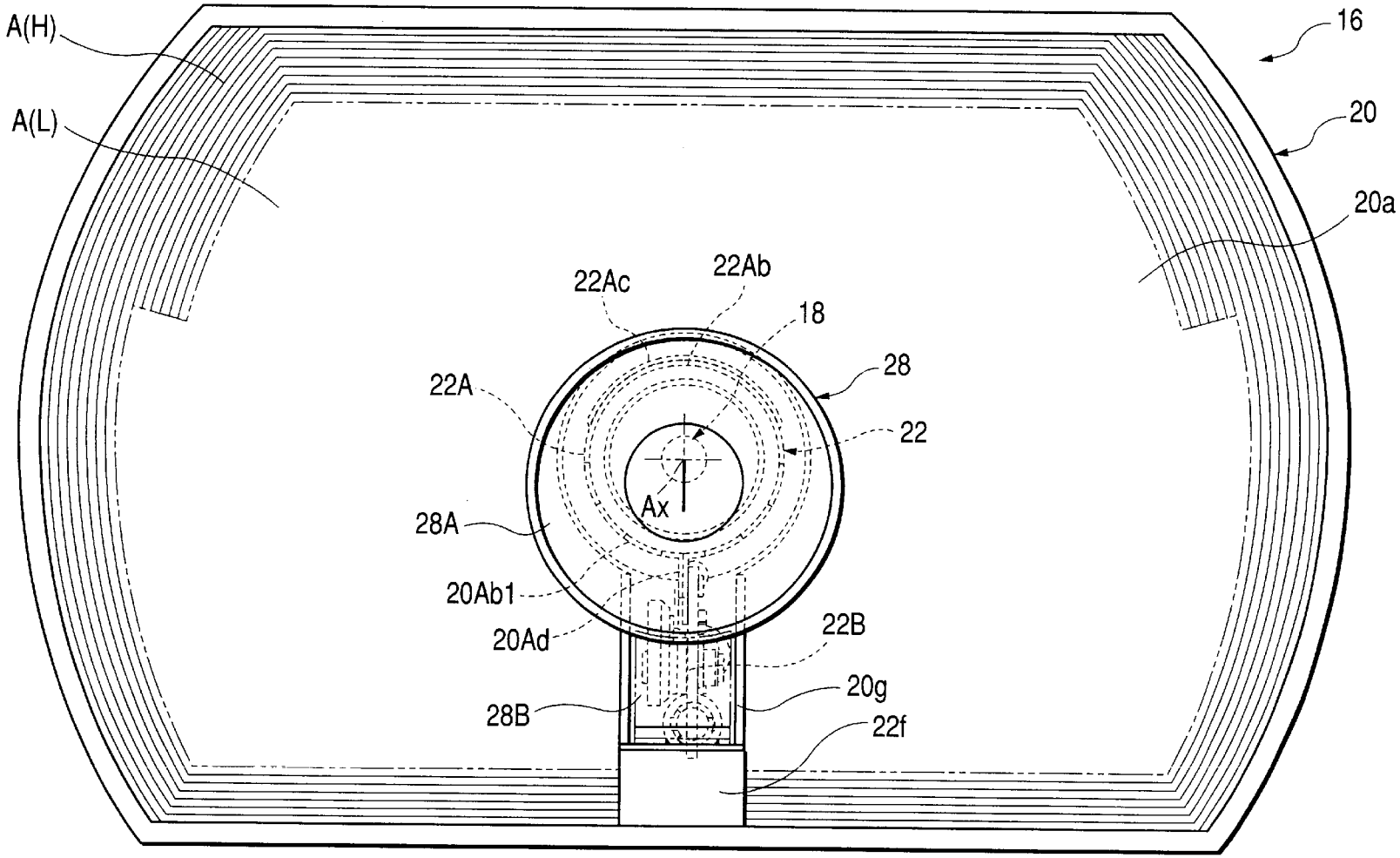
FIG. 3 is a view in an arrow mark III direction of FIG. 1.
Figure 4:
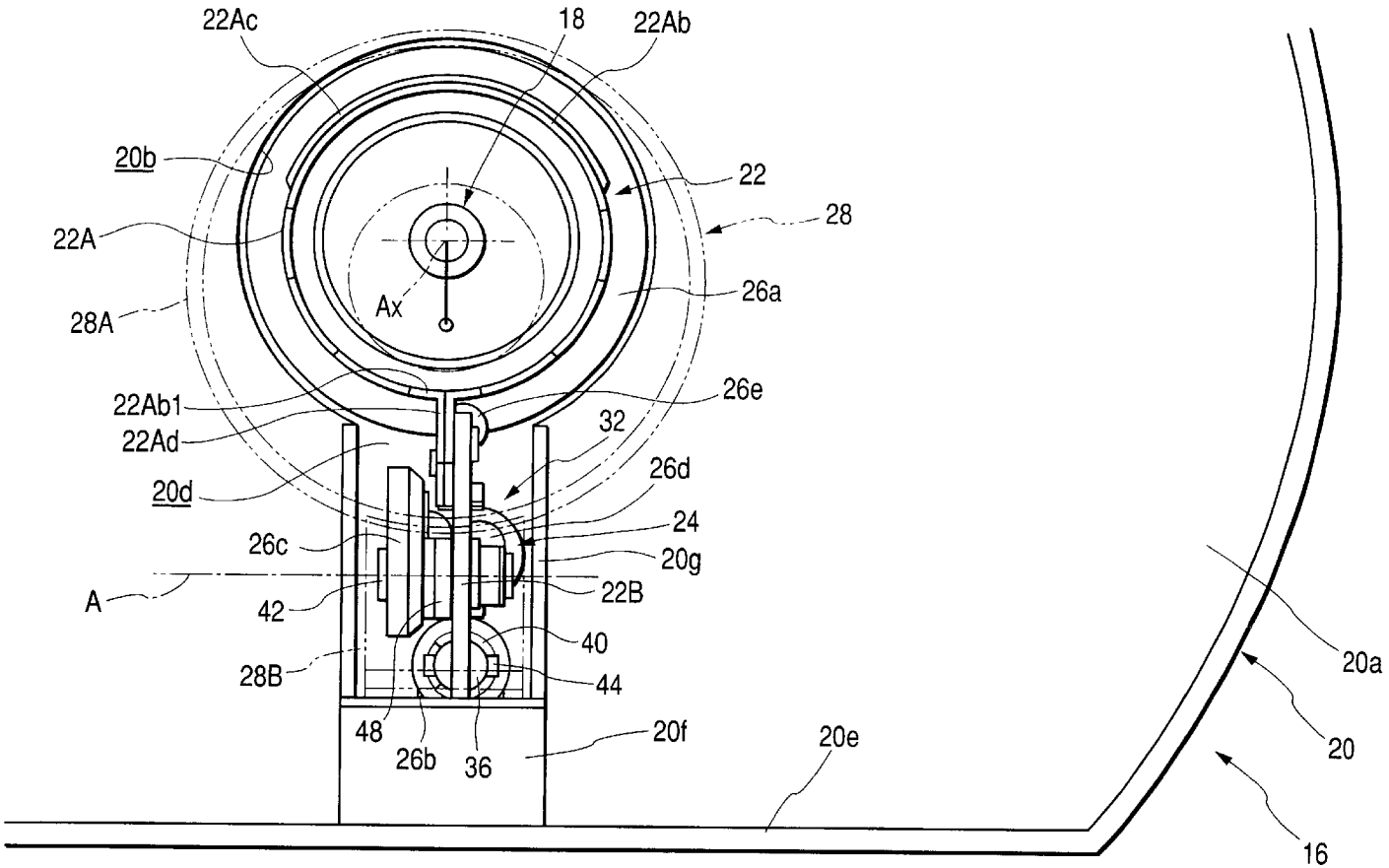
FIG. 4 is a detailed view of essential portions of FIG. 3.
Figure 5:
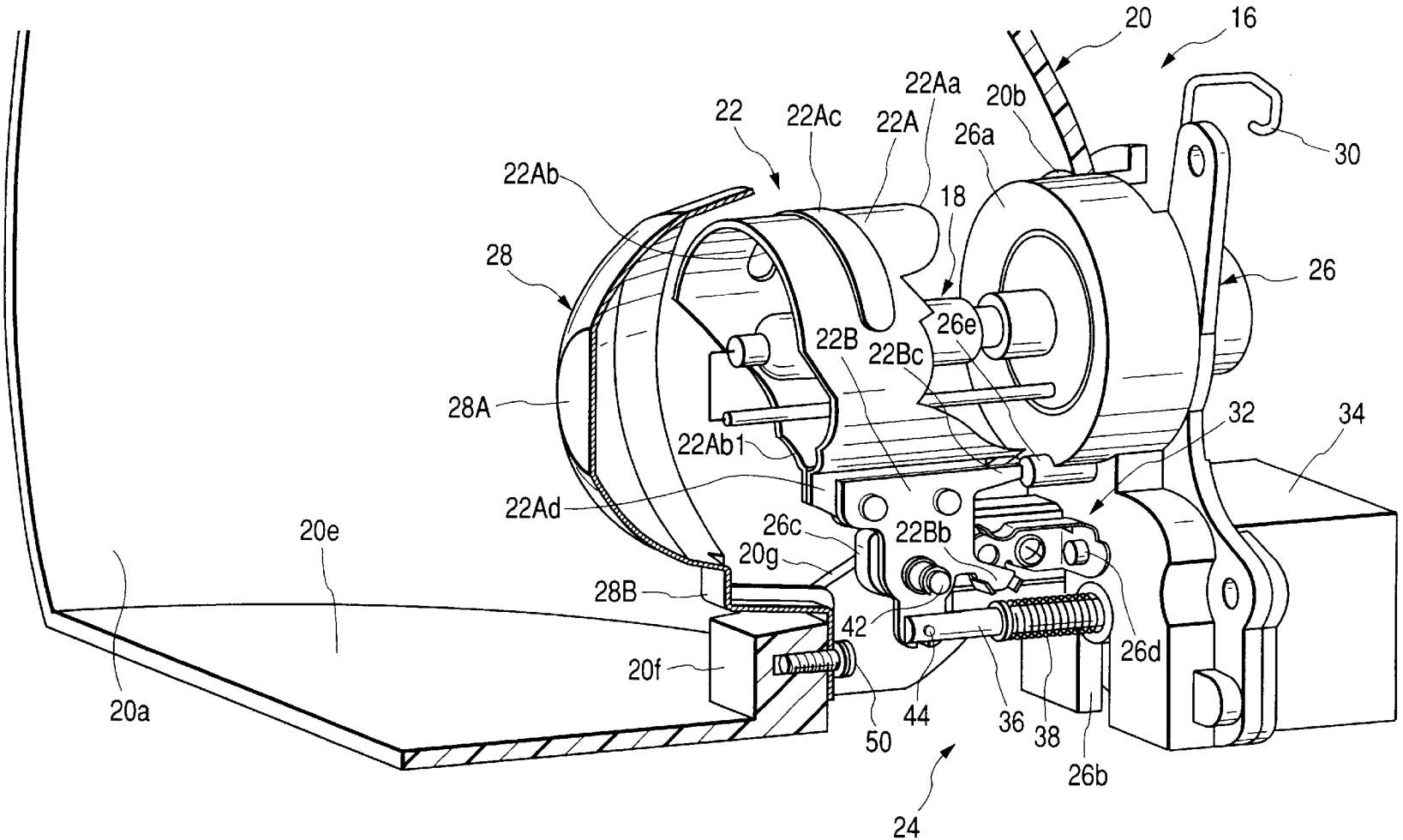
FIG. 5 is a sectional perspective view showing essential portions of the headlight for a vehicle in details.

FIG. 1 is a side sectional view showing a headlamp for a vehicle according to an embodiment of the invention and FIG. 2 is a detailed view of portion II of FIG. 1. Further, FIG. 3 is a view viewing FIG. 1 in an arrow mark III direction and FIG. 4 is a detailed view of essential portions of FIG. 3. Further, FIG. 5 is a sectional perspective view showing, in details, essential portions of the headlamp for a vehicle.

As shown by these drawings, according to a headlamp 10 for a vehicle of the embodiment, in a lamp chamber formed by a transparent cover 12 and a lamp body 14, a reflector unit 16 is provided angularly in the up and down direction and in the left and right direction via an aiming mechanism, not illustrated.

The reflector unit 16 includes a discharge bulb (metal halide bulb) 18, a reflector 20, a movable shade 22, a shade driving apparatus 24, a bulb supporting base 26 and a fixed shade 28.

Figure 6A:
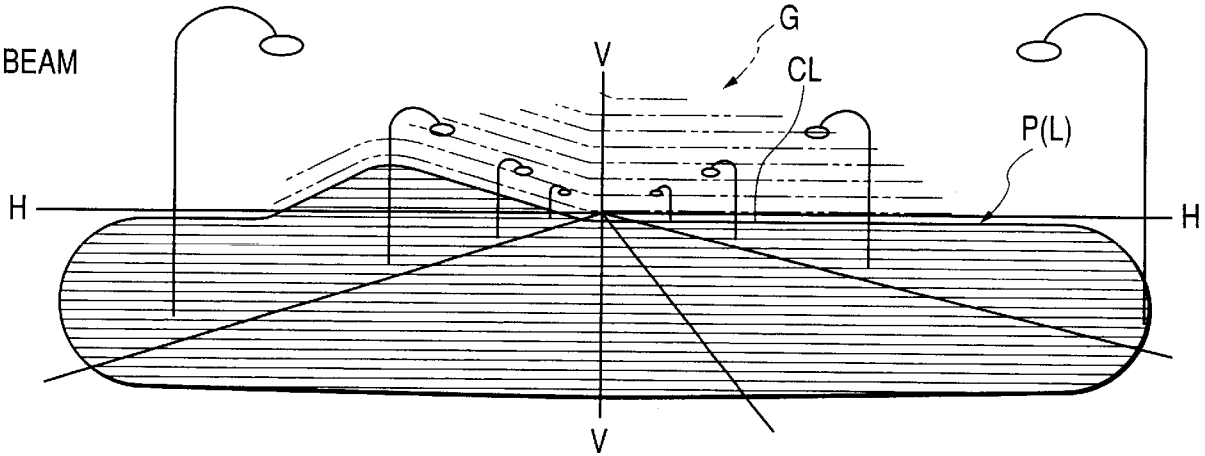
FIGS. 6(*a*) and 6(*b*) are views showing luminous intensity distribution patterns of beams illuminated from the headlamp for a vehicle in a front direction.
Figure 6B:
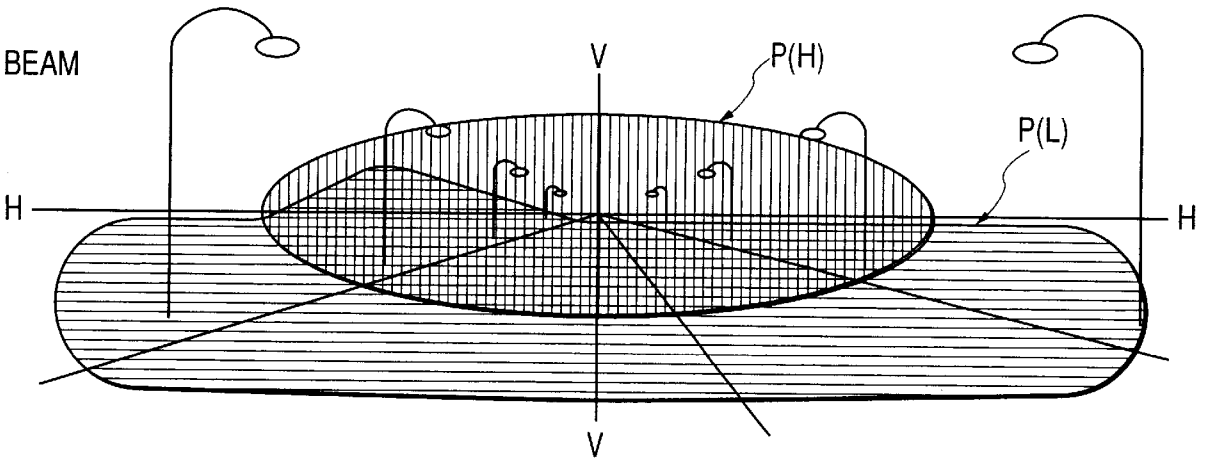

The transparent cover 12 is formed in a shape of passing light as it is, and the reflector unit 16 is provided with a luminous intensity distribution controlling function. That is, the reflector 20 of the reflector unit 16 is provided with a reflecting face 20*a* for reflecting light from a discharge light emitting portion 18*a* (light source) of the discharge bulb 18 in a front direction. By a diffusing or deflection-reflecting function of the reflecting face 20*a*, a beam for forming luminous intensity distribution patterns (which will be described later) as shown by FIGS. 6(*a*) and 6(*b*) is illuminated in a front direction.

The discharge bulb 18 is fixedly supported by the reflector 20 via the bulb supporting base 26. The bulb supporting base 26 includes a die-cast product and is screwed fixedly to bosses 20*c* provided at a plurality of portions of a back face of the reflector 20, which is inserted into a rear top opening portion 20*b* of the reflector 20 from a rear side. Further, the discharge bulb 18 is fixedly supported by a ring-like supporting portion 26*a* of the bulb supporting base 26 by a wire spring 30. The discharge light emitting portion 18*a* is positioned on an optical axis Ax of the reflector 20.

A rectangular opening portion 20*d* for communicating with the rear top opening portion 20*b* is formed at a lower portion of the rear top opening portion 20*b*. A shade moving mechanism of the shade driving apparatus 24 is contained in the rectangular opening portion 20*d*. Further, a lower face wall 20*e* is formed at a lower end portion of the reflecting face 20*a*, and a front end portion of the rectangular opening 20*d* in the lower face wall 20*e* is formed with a projected portion 20*f* for attaching the fixed shade to project in an upper direction. Further, a pair of erected wall portions 20*g* is formed at two left and right side portions of the rectangular opening portion 20*d*. A position of an upper end edge of each of the erected wall portions 20*g* is set to a height substantially the same as that of an upper face of the projected portion 20*f* for attaching the fixed shade at its front end portion and is set to a height substantially the same as a lower end portion of the rear top opening portion 20*b* at its rear end portion. The erected wall portions 20*g* are also set to be gradually higher in a rear direction at their middle portion.

The movable shade 22 includes a shade main body 22A in a cylindrical shape (shape of circular cylinder) extending in the front and rear directions and a shade leg portion 22B extending from a lower end portion of the shade main body 22A in a rear direction on a slightly rear side.

With regard to the shade main body 22A, its rear end edge 22A*a* is formed in a complicated irregular shape to block light incident on a peripheral area A(H) (which will be described later) of the reflecting face 20*a* from the discharge light emitting portion 18*a*. Meanwhile, a front end edge 22A*b* of the shade main body 22A is formed in a shape of a vertical face and a notch 22A*b*1 is formed at its lower portion. The notch 22A*b*1 is formed by a contour in an irregular shape skewedly lowered in a rear direction. The irregular shape is formed to ensure that the notch 22A*b*1 is as large as possible within a range of light, directed towards a front skewed lower direction from the discharge light emitting portion 18*a*, that can be blocked by the fixed shade 28 (which will be described later). Further, at a peripheral face portion of the shade main body 22A, there is formed a strip 22A*c* extending to ride over its apex position in a peripheral direction over a predetermined angular range (for example, range of about 120 degree). The strip 22A*c* is formed to project to a side of the outer peripheral face of the shade main body 22A. Alternatively, the strip 22A*c* can be formed to project to a side of an inner peripheral face of the shade main body 22A.

The shade main body 22A is formed by bending a metal plate into a cylindrical shape and is fixed to the shade leg portion 22B by rivets at its match portion 22A*d*. Prior to the bending, the strip 22A*c* is formed by pressing.

As seen in FIG. 2, the movable shade 22 can be moved by the shade driving apparatus 24 to be in a low beam position indicated by bold lines or in a high beam position indicated by two-dotted chain lines. Further, the movable shade 22 partially blocks light incident on the reflecting face 20*a* from the discharge light emitting portion 18*a* at the low beam position and passes more light at the high beam position. That is, referring to FIG. 3, at the low beam position, light directed to the peripheral area A(H) of the reflecting face 20*a* is blocked and only light directed to a central area A(L) is permitted to pass through. On the other hand, at the high beam position, light directed to a total area of the reflecting face 20*a* is permitted to pass through to generate a high beam.

FIGS. 6(*a*) and 6(*b*) are frontal views showing a luminous intensity distribution pattern of beam illuminated from the headlamp 10.

FIG. 6(*a*) shows a luminous intensity distribution pattern P(L) for low beam formed by reflected light from the central area A(L). FIG. 6(*b*) shows a luminous intensity distribution pattern for high beam, which is a combination of the luminous intensity distribution pattern P(L) for low beam and a luminous intensity distribution pattern P(H) formed by reflected light from the peripheral area A(H).

As shown by FIG. 6(*a*), the luminous intensity distribution pattern P(L) for low beam-is provided with a cutoff line (bright/dark boundary line) CL at its upper end portion to prevent the beam from casting glare to a driver of an opposed vehicle. However, when the movable shade 22 is shifted by vibration while a vehicle is running, light directed from the discharge light emitting portion 18*a* to the peripheral area A(H) of the reflecting face 20*a* cannot be completely blocked by the movable shade 22. Therefore, as shown by two-dotted chain lines in FIG. 6(*a*), glare light G produced by the reflected light from the peripheral area A(H), is illuminated to a space above the cutoff line C(L). In order to minimize the glare light G, it is important to reduce the shifting of the movable shade 22, and for that purpose, the inertia load should be made as small as possible by making the movable shade 22 light.

The shade driving apparatus 24 includes a solenoid 34 fixedly screwed to the bulb supporting base 26 on a lower side of the optical axis Ax of the reflector 20 and a return spring 38 mounted on a movable core 36 of the solenoid 34 for urging the movable core 36 to a nonexcited position.

The movable core 36 extends in a front direction to penetrate an inverse-U-like groove 26*b* formed at a lower end portion of the bulb supporting base 26 and is mounted with an E ring 40 brought into contact with a front end portion of the return spring 38 for receiving elastic urge force of the return spring 38 at its middle portion. Also, the core 36's front end portion is formed in left and right bifurcated shape.

The movable shade 22 is pivotably supported by a support bracket portion 26*c* formed at a middle portion of the shade leg portion 22B to project from the support base 26 in a front direction via a shaft member 42 around a pivotal axis line A extending in the left and right direction. Further, a ring-like spacer 48 is mounted between the shade leg portion 22B and the support bracket portion 26*a* to minimize occurrence of play at a connecting portion for connecting the shade leg portion 22B and the shaft member 42.

Further, the movable shade 22 is engaged and connected with a front end portion of the movable core 36 at a lower end portion of the shade leg portion 22B. The engaging and connecting operation is carried out by penetrating a pin 44 to the front end portion formed in the bifurcated shape of the movable core 36 in the left and right directions, forming a long groove 22B*a* extending in the up and down directions at the lower end portion of the shade leg portion 22B, and inserting the pin 44 into the long groove 22B*a*. When the movable shade 22 is pivoted, a distance between the shaft member 42 and the pin 44 is changed, but this change is absorbed by the sliding movement of the pin 44 in the long groove 22B*a*.

A displacement restricting member 32 is attached to a portion at a vicinity of a base end portion of the support bracket portion 26*c* of the bulb supporting base 26.

The displacement restricting member 32 is a bent article of a metal plate and includes an upper elastic piece 32A and a pair of lower elastic pieces 32B. The member 32 is fixed to a side face of the support bracket portion 26*c* by a screw 46 in a state of being engaged with a boss 26*d* formed at a front face of the bulb supporting base 26. The upper elastic piece 32A extends from the position of the front face of the bulb supporting base 26 in a front direction and its front end portion is formed in semicylinder shape directed to a lower side. The pair of lower elastic pieces 32B extends in side directions in a V-like arrangement from the position of the side face of the support bracket 26*c*.

At a lower portion of a rear end face of the shade leg portion 22B, there is formed a first projected portion 22B*b* projected in a rear direction to dispose between the elastic pieces 32A and 32B of the displacement restricting member 32. Upper end faces of the first projected portion 22B*b* extends in skewed lower directions, and lower end faces thereof are formed such that front end portions thereof are projected in a trapezoidal shape directed to a lower side. Further, when the movable shade 22 is pivoted to the high beam position, the first projected portion 22B*b* is brought into contact with the upper elastic piece 32A to elastically deform the upper elastic piece 32A. When the movable shade 22 is pivoted to the low beam position, the first projected portion 22B*b* is brought into contact with the lower elastic pieces 32B of the displacement restricting member 32 to elastically deform the lower elastic pieces 32B. Thereby, knocking sound emitted by the movable shade 22 in switching beam is reduced.

Further, a second projected portion 22B*c* projected to a rear side is formed at an upper portion of a rear end face of the shade leg portion 22B. Further, a stopper pin 26*e* projected to a front side is formed at a lower end portion of the ring-like supporting portion 26*a*. The projection of the stopper pin 26*e* to the front side is set such that when the movable shade 22 is disposed at the low beam position, a front end face of the stopper pin 26*e* is opposed to a rear end face of the second projected portion 22B*c* of the shade leg portion 22B at a slight interval therebetween. Further, the movable shade 22 is prevented beforehand from exceeding the low beam position and pivoting excessively by operation of bringing the second projected portion 22B*c* into contact with the stopper pin 26*e*.

The fixed shade 28 covering the movable shade 22 is provided at a vicinity of a front side of the movable shade 22. The fixed shade 28 is integrally formed with a shade main body 28A in a cap-like shape and a shade leg portion 28B having a section in a shape of a channel extending from a lower end portion of the shade main body 28A to a lower side and offset to a rear side at its middle portion. Further, the fixed shade 28 is fixedly fastened to a rear face of the projected portion 20*f* for attaching the fixed shade by a screw 50 from a rear side at a lower end portion of the shade leg portion 28B. The shade leg portion 28B is formed by a width substantially the same as a width of the rectangular opening portion 20*d*. By inserting the shade leg portion 28B into the rectangular opening portion 20*d*, the shade leg portion 28B is sandwiched by the erected wall portions 20*g* on its both sides.

The headlamp 10 for a vehicle according to the embodiment is provided with the movable shade 22 including the shade main body 22A in the cylindrical shape extending in the front and rear direction and the shade leg portion 22B extending from the lower end portion of the shade main body 22A to the lower side. The upper end portion of the peripheral face of the shade main body 22A is formed with the strip 22A*c* extending in the peripheral direction and therefore, rigidity of the shade main body 22A can be increased and the shape main body 22A can have a thin wall. Further, the strip 22A*c* is formed at the upper end portion of the peripheral face of the shade main body 22A, which is operated with the largest inertia load. Therefore, the movable shade 22 is prevented from shifting by vibration or the like while the vehicle is running. Further, the glare light G directed to the space above the cutoff line CL in the luminous intensity distribution pattern P(L) for low beam as shown by the two-dotted chain lines in FIG. 6(*a*) can be reduced or eliminated.

Thus, according to the embodiment, the light-weighted formation can be achieved without deteriorating the light blocking function of the movable shade.

Further, according to the embodiment, the movable shade 22 is pivotally moved in the front and rear directions with the predetermined portion of the shade leg portion 22B as the pivotal center. Therefore, a very large inertia load is placed at the upper end portion of the peripheral face of the shade main body 22A. Thus, it is particularly effective to form the strip 22A*c* at the upper end portion of the peripheral face of the shade main body 22A.

Further, according to the embodiment, the shade leg portion 22B extends to the lower side from the lower end portion of the shade main body 22A, and the strip 22A*c* is formed at the upper end portion of the peripheral face of the shade main body 22A. Thus, the rigidity of the shade main body 22A can be enhanced with excellent left and right balance, thereby, further restraining any shifts of the movable shade 22.

Further, according to the embodiment, the fixed shade 28 is provided on the front side of the movable shade 22 and therefore, light directed to the front side from the discharge light emitting portion 18*a* can be blocked by the fixed shade 28. Further, by providing the fixed shade 28 in this way, the movable shade 22, the shade moving mechanism of the shade driving apparatus 24 and the like can be hidden from the front side of the lighting apparatus, thereby, promoting the appearance of the lighting apparatus.

It is preferable to downsize the fixed shade 28 such that the reflected light from the reflected face 20*a* is blocked as least as possible. However, when the fixed shade 28 is downsized, the movable shade 22, the shade moving mechanism of the shade driving apparatus 24 and the like become easy to see from the front side of the lighting apparatus unless the fixed shade 28 is provided at a position proximate to the movable shade 22. Further, when the fixed shade 28 is made to be proximate to the movable shade 22, the fixed shade 28 interferes with the movable shade 22 in pivoting the movable shade 22 toward the high beam position.

In this respect, according to the embodiment, the notch 22A*b*1 is formed at the lower portion of the front end edge 22A*b* of the shade main body 22A of the movable shade 22 (front portion of extended position of the shade leg portion 22B). Therefore, the movable shade 22 is not prone to interfere with the fixed shade 28 in the pivotal movement. That is, as shown by broken lines in FIG. 2, when the notch 22A*b*1 is not assumedly formed at the lower portion of the front end edge 22A*b*, the front end edge 22A*b*' interferes with the fixed shade 28, however, according to the embodiment, such an interference is not caused. Therefore, according to the embodiment, it is possible to downsize the fixed shade 28 and provide the fixed shade 28 at the position proximate to the movable shade 22. Further, by forming the notch 22A*b*1, the movable shade 22 can be made light.

Figure 7:
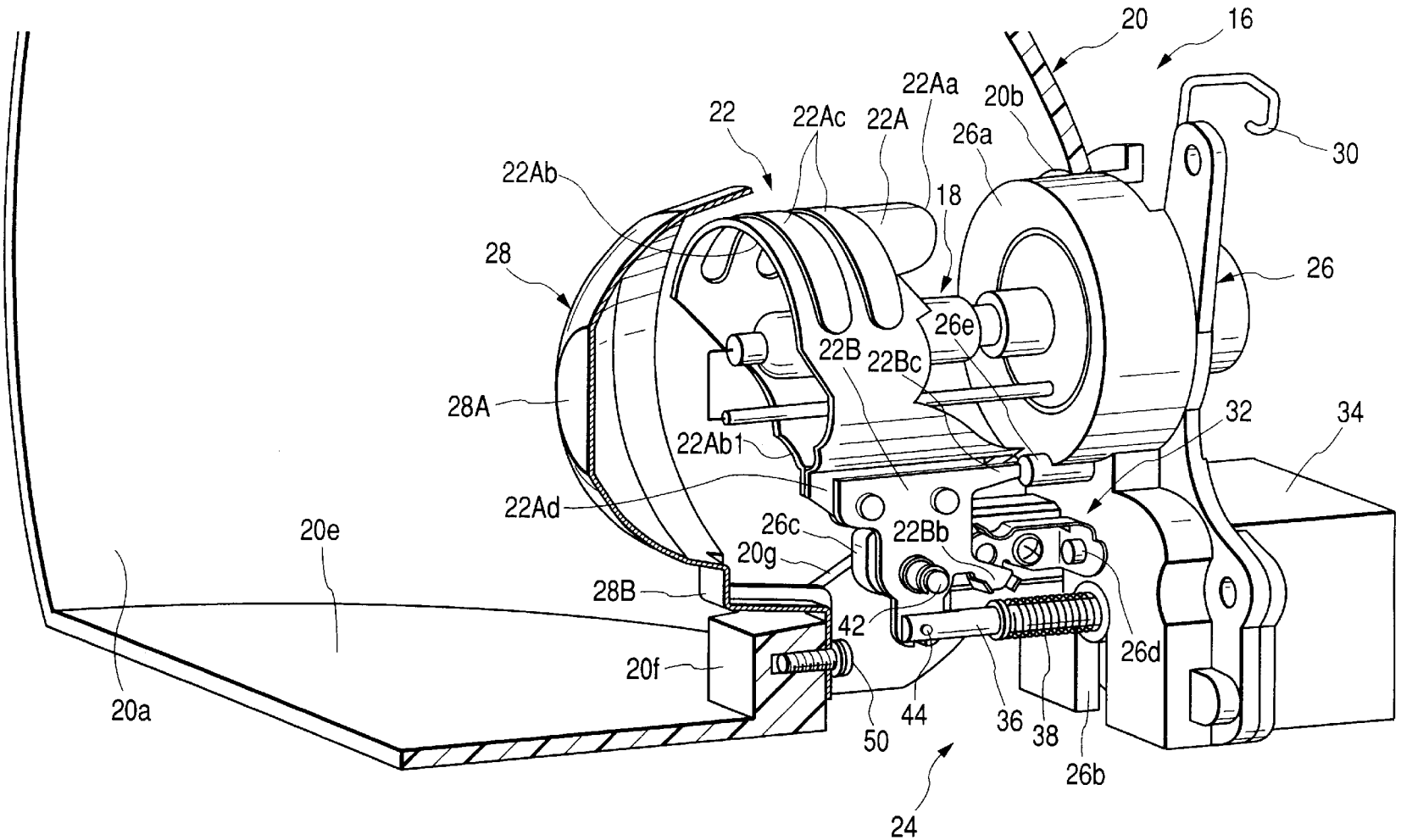
FIG. 7 is a view similar to FIG. 5 showing a first modified example of the embodiment.
Figure 8:
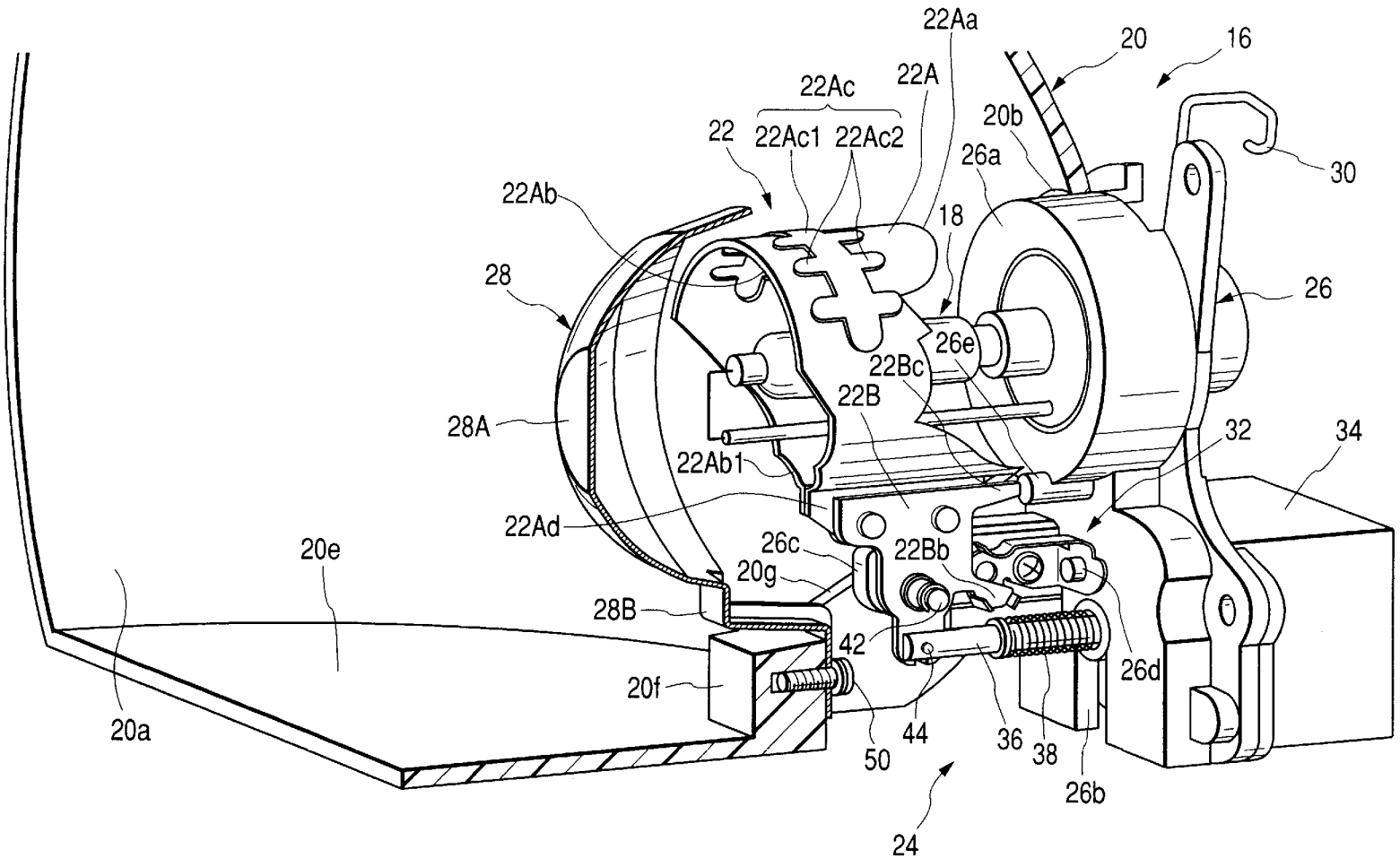
FIG. 8 is a view similar to FIG. 5 showing a second modified example of the embodiment.

FIGS. 7 and 8 are views similar to FIG. 5 showing a first and a second modified example of the embodiment.

Referring to FIG. 7, according to the first modified example, there are formed two pieces of the strips 22A*c* extending linearly in the peripheral direction similar to the above embodiment at the upper end portion of the peripheral face of the shade main body 22A in the front and rear direction at a predetermined interval therebetween. By increasing a number of pieces of forming the strips 22A*c* in this way, the rigidity of the shade main body 22A can further be increased, thereby, further restraining the shifting of the movable shade. Further, three pieces or more of the strips 22A*c* can naturally be formed.

Referring to FIG. 8, according to the second embodiment, there is constructed a constitution in which a single piece of the strip 22A*c* is formed at the upper end portion of the peripheral face portion of the shade main body 22A, and the strip 22A*c* includes a main strip 22A*c*1 extending in the peripheral direction and a plurality of sub strips 22A*c*2 branched from the main strip 22A*c*1 and extending in the front and rear direction. By forming the strip 22A*c* to extend not simply linearly in the peripheral direction but also to branch in other directions, the rigidity of the shade main body 22A can further be increased. Thus, the shifting of the movable shade 22 can be further restrained.

The present invention claims priority from Japanese patent application serial no. 2000-334178 filed Nov. 1, 2000, which is incorporated herein by this reference in its entirety.

Several embodiments of the invention have been described herein, but it should be understood that various additions and modifications could be made which fall within the scope of the following claims.

What is claimed is:

1. A headlamp for a vehicle comprising:

a light source;

a reflector for reflecting light from the light source in a front direction;

a movable shade capable of blocking a portion of the light incident on the reflector from the light source; and a shade driving apparatus for moving the movable shade between two predetermined positions at which the incident light is blocked in different degrees, wherein the movable shade comprises:

a shade main body of a cylindrical shape extending substantially in a front and rear direction;

a shade leg portion extending from the shade main body; and at least one strip formed on the outer surface of the shade main body.

2. The headlamp for a vehicle according to claim 1, wherein said shade leg portion extends to an outer side of the shade main body substantially in a direction of a diameter thereof.

3. The headlamp for a vehicle according to claim 1, wherein said strip is disposed at a position substantially opposite to a position of the shade leg portion in a peripheral face portion of the shade main body.

4. The headlamp for a vehicle according to claim 1, wherein the shade leg portion extends to a lower side from a lower end portion of the shade main body.

5. The headlamp for a vehicle according to claim 1, wherein the movable shade is pivotally moved in the front and rear direction with a predetermined portion of the shade leg portion as a pivotal center.

6. The headlamp for a vehicle according to claim 2, wherein the movable shade is pivotally moved in the front and rear direction with a predetermined portion of the shade leg portion as a pivotal center.

7. The headlamp for a vehicle according to claim 3, wherein a fixed shade for blocking direct light from the light source in the front direction is provided on a front side of the movable shade, and wherein a front portion of the extended position of the shade leg portion in the movable shade has a notch of a predetermined shape.

8. The headlamp for a vehicle according to claim 4, wherein a fixed shade for blocking direct light from the light source in the front direction is provided on a front side of the movable shade, and wherein a front portion of the extended position of the shade leg portion in the movable shade has a notch of a predetermined shape.

9. The headlamp for a vehicle according to claim 1, wherein the strip includes a plurality of sub strips extending in a front and rear direction.

10. The headlamp for a vehicle of claim 1, wherein the strip is formed in a direction perpendicular to a longitudinal axis of the shade main body.

* * * * *